US008695627B2

(12) United States Patent
Kugelev et al.

(10) Patent No.: US 8,695,627 B2
(45) Date of Patent: Apr. 15, 2014

(54) STAND FOR PRESSURE RELIEF VALVE

(75) Inventors: Vladimir Kugelev, Arlington, TX (US); Mark D. Matzner, Burleson, TX (US)

(73) Assignee: S.P.M. Flow Control, Inc., Fort Worth, TX (US)

( * ) Notice: Subject to any disclaimer, the term of this patent is extended or adjusted under 35 U.S.C. 154(b) by 732 days.

(21) Appl. No.: 12/822,900

(22) Filed: Jun. 24, 2010

(65) Prior Publication Data

US 2010/0326541 A1 Dec. 30, 2010

Related U.S. Application Data

(60) Provisional application No. 61/220,067, filed on Jun. 24, 2009.

(51) Int. Cl.
*F16L 3/10* (2006.01)
*F17D 1/00* (2006.01)

(52) U.S. Cl.
USPC ..... 137/363; 137/372; 137/373; 137/377

(58) Field of Classification Search
USPC ..... 137/343, 356, 363, 364, 365, 366, 367, 137/368, 372, 373, 377, 382, 382.5; 166/75.15, 96.1, 177.5; 405/184.4
See application file for complete search history.

(56) References Cited

U.S. PATENT DOCUMENTS

| | | | | | |
|---|---|---|---|---|---|
| 741,477 | A | * | 10/1903 | Flinn | 137/366 |
| 1,488,211 | A | * | 3/1924 | Loeffler | 166/96.1 |
| 1,543,637 | A | * | 6/1925 | Woll | 166/93.1 |
| 1,607,463 | A | * | 11/1926 | Kent | 166/92.1 |
| 2,339,287 | A | * | 1/1944 | Neef, Jr. | 222/173 |
| 2,606,068 | A | * | 8/1952 | Bonacor | 137/376 |
| 2,795,459 | A | * | 6/1957 | Cornelius | 137/291 |
| 3,150,681 | A | * | 9/1964 | Hansen et al. | 137/454.2 |
| 4,171,095 | A | * | 10/1979 | Filan et al. | 239/200 |
| 4,378,849 | A | * | 4/1983 | Wilks | 166/369 |
| 4,605,036 | A | * | 8/1986 | Smith et al. | 137/327 |
| 4,993,489 | A | * | 2/1991 | McLeod | 166/72 |
| 5,522,420 | A | * | 6/1996 | Martin | 137/343 |
| 6,079,439 | A | * | 6/2000 | Hartley | 137/377 |

* cited by examiner

*Primary Examiner* — Craig Schneider
*Assistant Examiner* — Jonathan Waddy
(74) *Attorney, Agent, or Firm* — Gardere Wynne Sewell LLP

(57) ABSTRACT

A frame for supporting a pressure relief valve located within a frac line connected to high pressure pumps on frac trucks. A metallic base is formed from rectangular tubing in the shape of a box. Saddles on the base support a tee on the lower portion of the relief valve. Brace links are connected at one end to the corners of the metallic base and swivel about clevises to allow access to the pressure relief valve. The other end of the brace links connect to clevises on a flange when assembled. The flange is rigidly connected to an upper portion of the relief valve to stabilize the assembly. Lifting loops on the flange allow the frame to be lifted during assembly.

20 Claims, 5 Drawing Sheets

STAND FOR PRESSURE RELIEF VALVE

CROSS-REFERENCE TO RELATED APPLICATION

This application claims priority to provisional application 61/220,067, filed Jun. 24, 2009, and is herein incorporated by reference in its entirety.

FIELD OF THE INVENTION

This invention relates in general to fracturing and other high pressure oilfield operations, and, in particular, to a stand for a pressure relief valve that prevents the valve from tipping over when flow lines move during operation and when pressure is released.

BACKGROUND OF THE INVENTION

One type of treatment for an oil or gas well is referred to as well fracturing or a well "frac." The operator connects an adapter to the upper end of a wellhead member such as a tubing head and pumps a liquid at a very high pressure down the well to create fractures in the earth formation. The operator also disburses beads or other proppant material, also known as frac media, in the fracturing fluid to enter the cracks to keep them open after the high pressure is removed. This type of operation is particularly useful for earth formations that have low permeability but adequate porosity and contain hydrocarbons, as the hydrocarbons can flow more easily through the fractures created in the earth formation.

To introduce the frac media into the formation, high pressure pumps typically mounted on trucks, are employed at a well site. Frac lines are connected to the pumps and connected to the wellhead. The pressure employed during the frac operation may be many times the natural earth formation pressure that ordinarily would exist. For example, the operator might pump the fluid at a pressure of 8,000 to 9,000 psi. The normal pressure that might exist in the wellhead might be only a few hundred to a few thousand psi. Because of this, the frac lines experience high pressures that can be dangerous to personnel and destructive to equipment. Pressure relief valves are thus used to relieve pressure in the frac lines. However, the pressure relief valves may topple due to the pressure in the frac line. Improvements to the stability of the pressure relief valve are sought.

SUMMARY OF THE INVENTION

A frame for supporting a pressure relief valve located within a frac line connected to high pressure pumps on frac trucks. A metallic base is formed from rectangular tubing in the shape of a box. Saddles on the base support a tee on the lower portion of the relief valve. Brace links are connected at one end to the corners of the metallic base and swivel about clevises to allow access to the pressure relief valve. The other end of the brace links connect to clevises on a flange when assembled. The flange is rigidly connected to an upper portion of the relief valve to stabilize the assembly. Lifting loops on the flange allow the frame to be lifted during assembly.

In an embodiment of the present technique, a frame for a pressure relief valve is provided that provides a stable base for the pressure relief valve. The frame has a metallic base that can be set on the ground. The metallic base can be fabricated from rectangular tubing joined end to end to form a rectangular box. For added stability, gussets can be used at each corner. Saddles are fastened to cross braces on the lower portion of the metallic base. A clamp fastens to the saddles to secure a tee located at the bottom end of the pressure relief valve. The tee connects to frac lines running from frac trucks and to the wellhead.

Brace links are connected to clevises located on each top corner of the metallic base. The clevises are oriented inward at approximately a 45 degree angle and function to allow swiveling of the brace links. This allows for access to the valve when the links are not connected at their top ends. A flange with clevises is bolted to an upper end of the pressure relief valve, such as a cylinder operating the valve. The upper ends of the brace links are then fastened to the clevises. The flange also has lifting loops that allow lifting during assembly. In addition, a lifting loop can be welded to the top of the valve to allow lifting of the frame and valve assembly as a whole. The result is a rigid frame that advantageously provides stability to the pressure relief valve while allowing access to the pressure relief valve for maintenance.

DETAILED DESCRIPTION OF THE INVENTION

Figure 1:
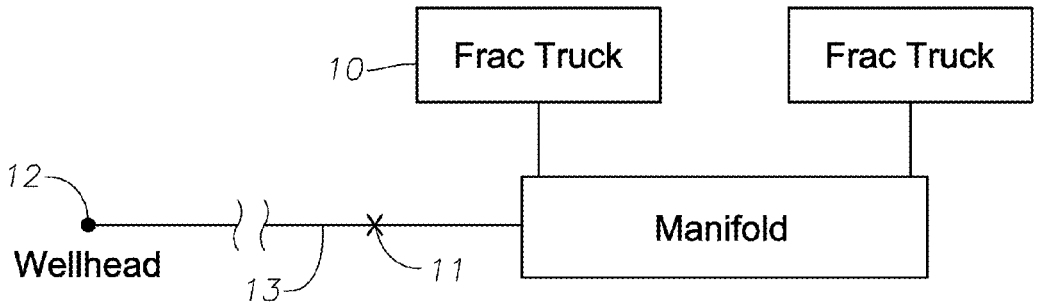
FIG. 1 is a schematic layout of one embodiment of a frac job showing the location of valve stand assemblies, and is constructed in accordance with the invention.

Referring to FIG. 1, one embodiment of a fracturing (frac) job layout is schematically illustrated to show typical locations for a plurality of pressure relief valve assemblies 11. High pressure pumps on frac trucks 10 are connected to the wellhead 12 via flow frac lines 13 as shown. The pressure relief valve assembly 11 is denoted with an "X" in the frac lines 13.

Figure 2:
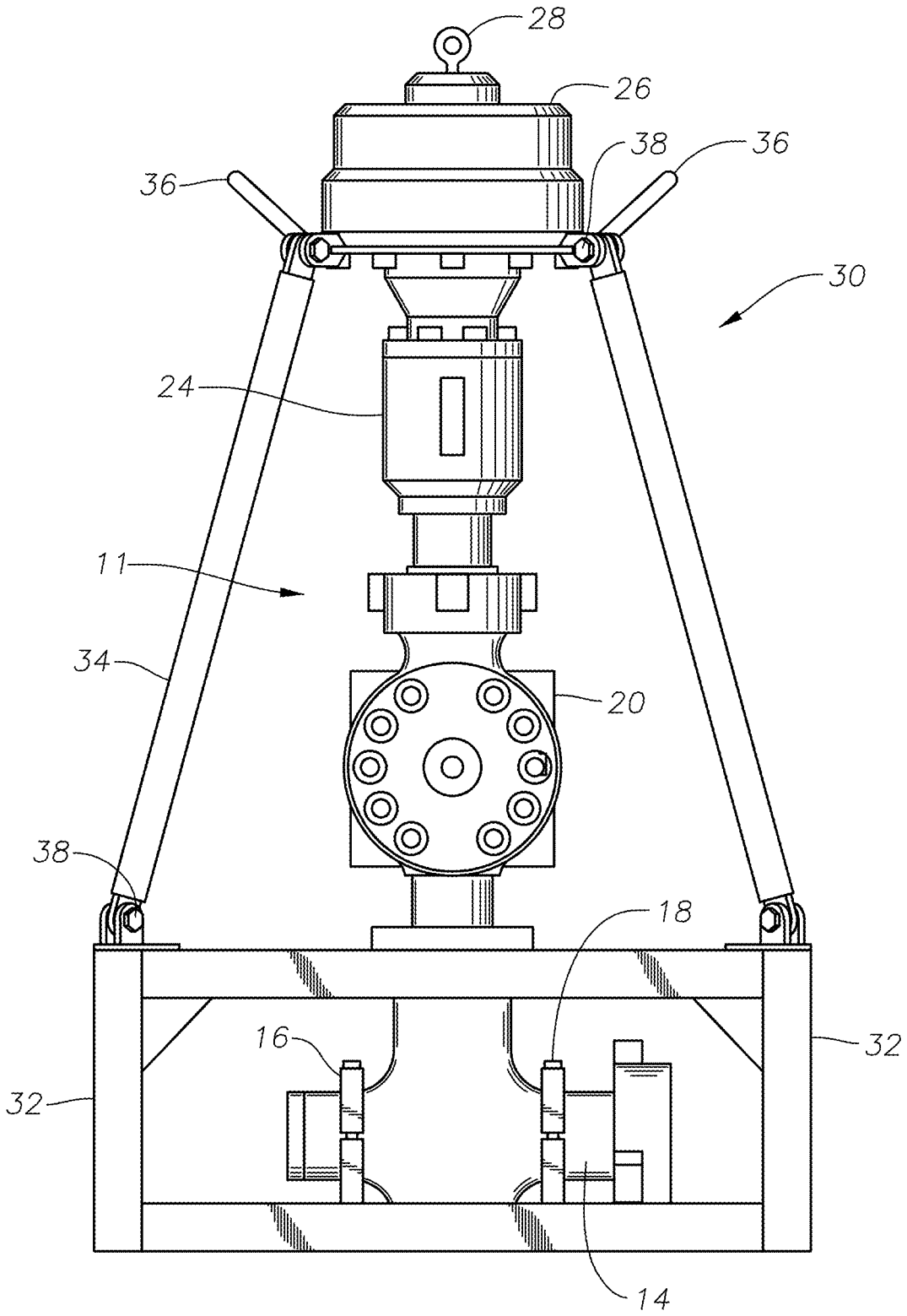
FIG. 2 is an enlarged side view of one embodiment of a stand assembly for a pressure relief valve assembly, and is constructed in accordance with the invention.
Figure 3:
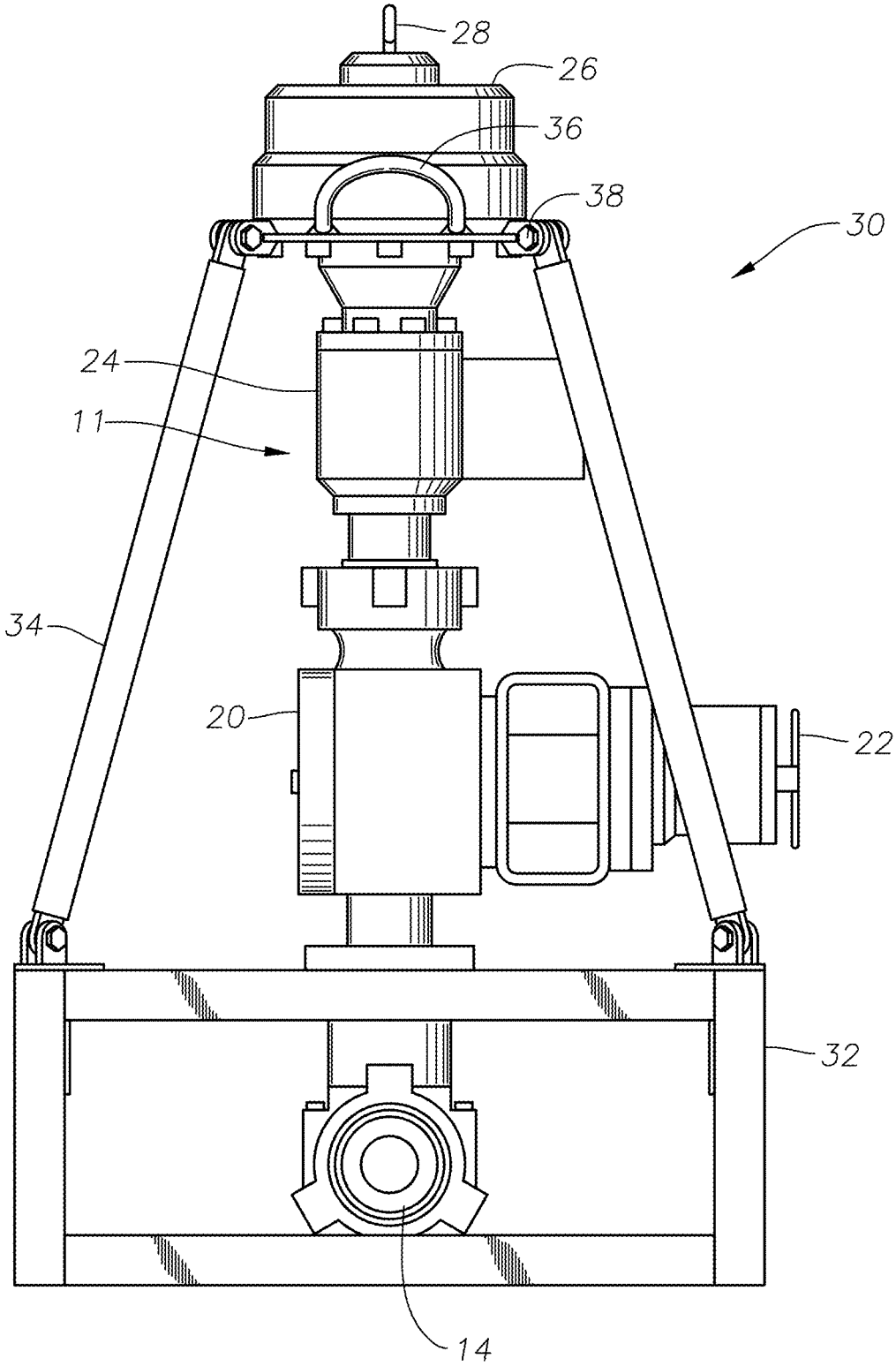
FIG. 3 is a different side view of the stand assembly of FIG. 2, and is constructed in accordance with the invention.

FIGS. 2 and 3 show different views of one embodiment of a stand assembly 30 used to support each pressure relief valve assembly 11; shown included with the stand assembly 30 is a tee 14 with coaxial ends shown generally horizontal and connected to the frac lines 13. A clamp 16 and screw 18 set secure the tee 14 of relief valve assembly 11 to a frame 32 (FIG. 2). The tee 14 also includes a vertical lead on which a plug valve 20 is mounted. An indicator 22 is provided with the plug valve 20 for indicating if the plug valve 20 is open or closed. A relief valve 24 connects to a top portion of the plug valve 20. A cylinder 26 for operating the relief valve 24 has a loop 28 for lifting that is attached to the top portion of the relief valve 24. The loop 28 can be sized to allow lifting of the relief valve assembly 11.

In the illustrated embodiment, a stand assembly 30 comprising frame 32, brace links 34, and flanges 36, provides a frame for the relief valve assembly 11 and allows for lifting of the stand assembly 30. The brace links 34 are illustrated as generally elongated cylindrical members, the brace links 34 may optionally be tubular as well. Each brace link 34 is shown having an end that connects to the frame 32 with a bolt set 38. The other end of brace links 34 connect to the flanges 36 with a bolt set 38. In an example embodiment, the bolt sets 38 are tightened to make the stand assembly 30 rigid. In the example embodiments of FIGS. 2 and 3, one brace link 34 is located at each upper corner of the frame 32. The top ends of the brace links 34 are disposed inward to connect with the corners of the flanges 36.

Figure 4:
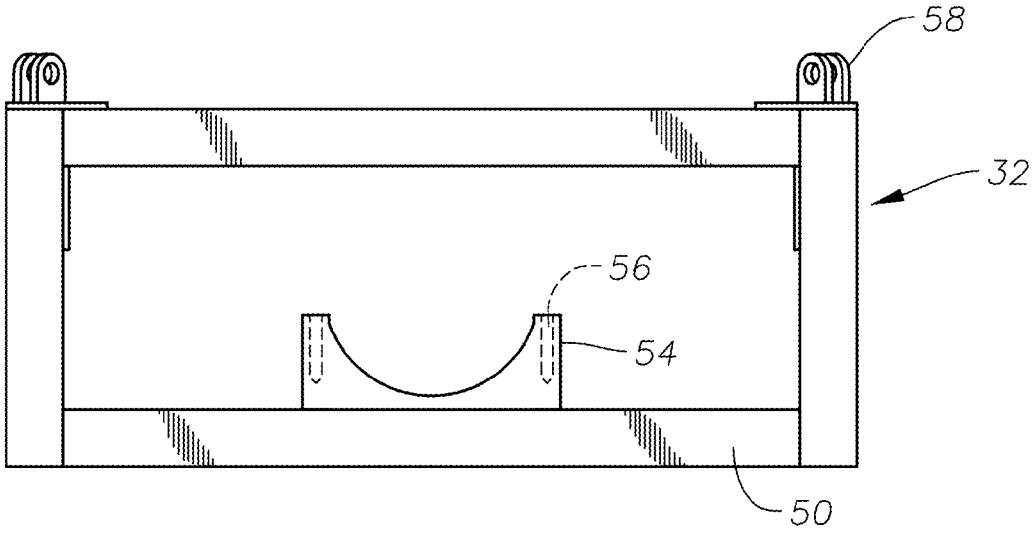
FIG. 4 is a an enlarged side view of a frame for the stand assembly, and is constructed in accordance with the invention.
Figure 5:
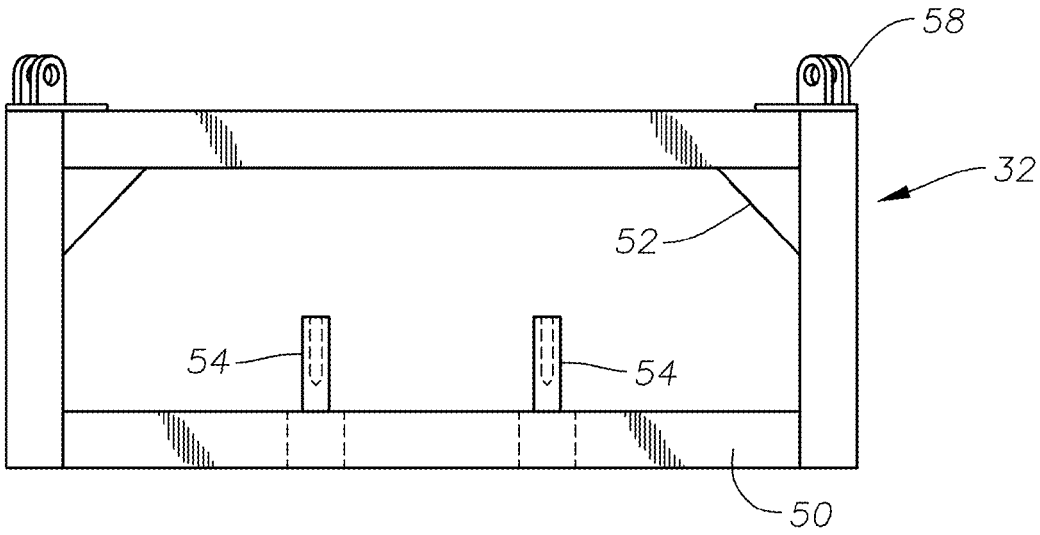
FIG. 5 is a different side view of the stand assembly of FIG. 4, and is constructed in accordance with the invention.
Figure 6:
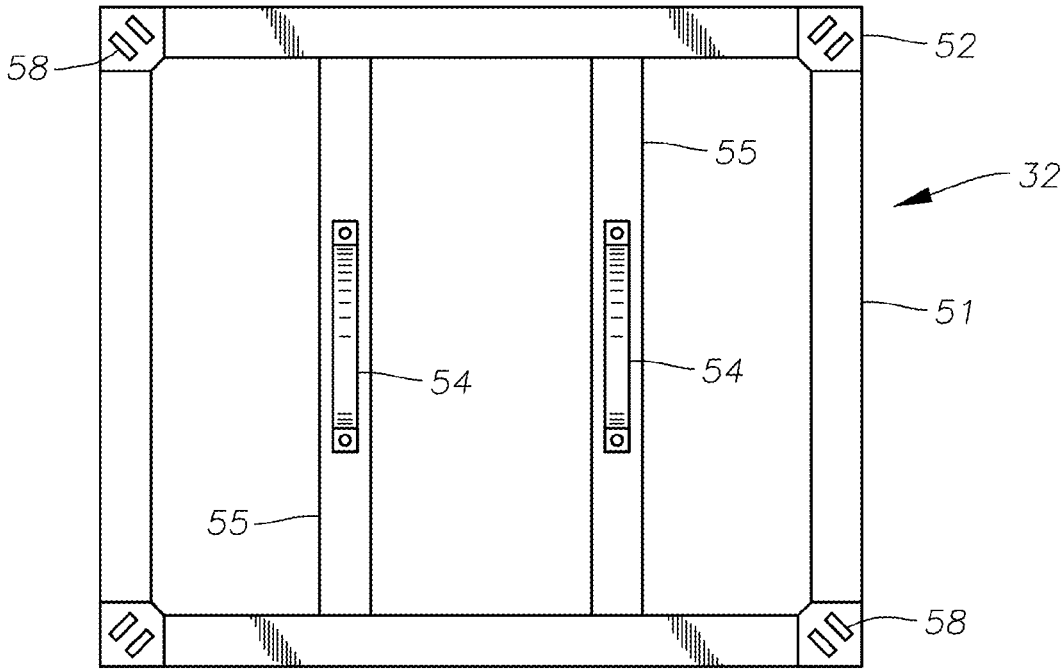
FIG. 6 is a an enlarged top view the stand assembly of FIG. 4, and is constructed in accordance with the invention.

As shown in FIGS. 4, 5, and 6, the frame 32 can be comprised of steel rectangular tubing 51 connected to each other and welded at the corners. Cornerpieces or gussets 52 can be provided at the corners to provide additional stability to the frame by coupling together vertical and horizontal tubing 51. As shown in a top view in FIG. 6, the assembled rectangular tubing 51 forms a rectangular frame 32. Frame 32 could be other shapes rather than rectangular. A plurality of saddles 54 are shown that are generally planar members having a semicircular recess formed on an upward facing end. The saddles 54 may be welded to additional cross braces 55 shown horizontally mounted between lower side of frame 30. The cross braces 55 for the saddles 54 are connected at each end to parallel pieces of rectangular tubing 51 that on opposing sides of the frame 30 that form a lower portion 50 of the frame 30. The ends of cross braces 55 can be welded to the rectangular tubing 51. The recess formed on the saddles 54 is formed to receive the tee 14 of the relief valve assembly 11. The tee 14 is secured to each saddle 54 with clamp 16 and screws 18 that engage screw openings 56 (FIG. 4) in the saddles (FIGS. 2 and 3). Pairs of planar devises 58 are shown located at each of the top corners of the frame 32. Each pair of devises 58 are generally parallel having a horizontal bore formed therethrough. Clevises 58 may be welded to the frame 32 and aligned with devises 58 provided diagonally across the frame 32. The bores in each pair of devises 58 is registerable with a bore provided in the lower end of each of the brace links 34. Inserting the bolt set 38 through the registered bores in the devises 58 and lower end of the brace links 34 forms a swiveling coupling between the brace links 34 and the frame 32 (FIG. 2).

Figure 8:
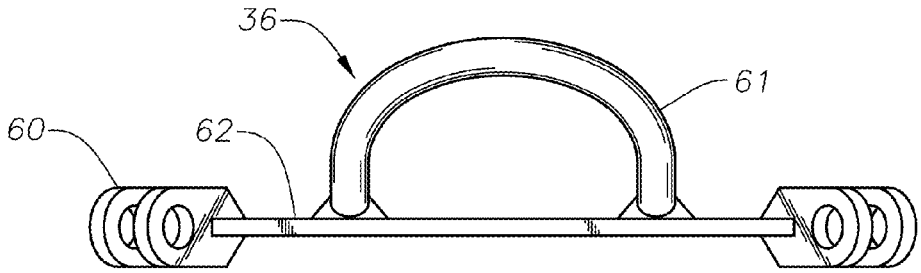
FIG. 8 is a side view of the flange of FIG. 7, and is constructed in accordance with the invention.
Figure 7:
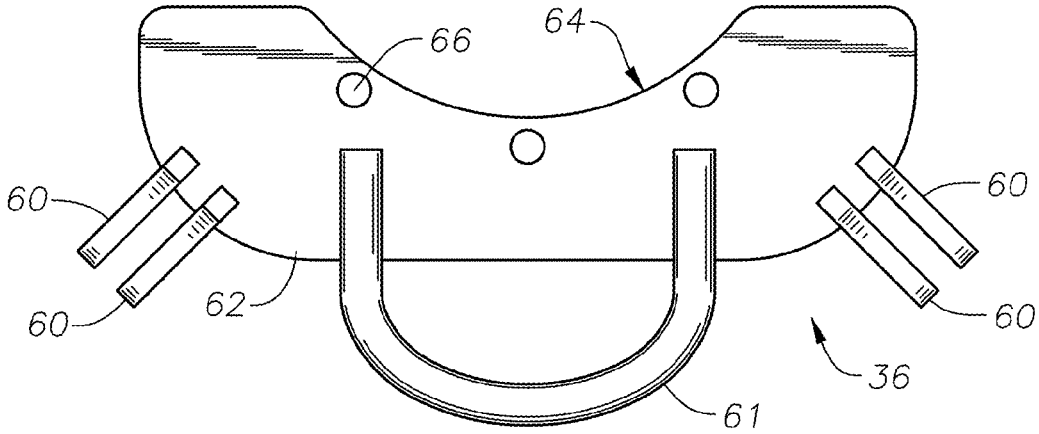
FIG. 7 is a an enlarged top view of a flange for the stand assembly, and is constructed in accordance with the invention.

Enlarged views of an example embodiment of flange 36 are shown in FIGS. 7 and 8. The flange 36 is shown having a generally rectangular flange plate 62 with a pair of clevises 60 provided at adjacent corners disposed at opposing ends of an elongate side of the plate 62. The pairs of clevises 60 are shown angled away from one another. Each flange clevis 60 has a bore formed in a middle portion that can register with a bore provided in an upper end of one of the brace links 34. The brace link 34 may be secured to each pair of clevises 60 with a bolt set 38 inserted through the registered bores.

A U-shaped lifting loop 61 is illustrated having its free ends welded to each flange plate 62 to allow for lifting during assembly. During installation, slings may be looped through the loops 61 to allow for lifting of the combined assembly comprising the stand assembly 30 and relief valve assembly 11. Bolt openings 66 formed on the plate 62 and disposed in an arc along concave inner plate surface 64, allow bolts and nuts to fasten the flange 36 to the cylinder 26 of the relief valve assembly 11. Referring now to the example embodiment of FIG. 2, two flanges 36 are shown fastened to the relief valve assembly 11 on opposing sides of the cylinder 26. The arc 64 is formed to accommodate the outer curvature of the cylinder 26; thus a rigid connection is formed between the relief valve assembly 11 and the stand assembly 30. The top ends of the brace links 34 can be disconnected from the flanges 36 and swiveled diagonally outward at the frame clevises 58 to allow access to the valve assembly 11 and its components during maintenance.

In additional embodiments (not shown), a ball bearing swivel connection can be used in place of the clevises 58, 60 that receive the ends of the brace links 34.

In additional embodiments (not shown), a quick disconnect assembly can be used to connect the ends of the brace links 34 to the frame 32 and flanges 36.

In additional embodiments (not shown), the space between the saddles 54 can be adjusted to allow for varying sizes of tees 14.

The high pressures in fracing job flow lines create possible dangers during disassembly or disconnecting of in-line components. An inadvertent disconnection in the pressurized piping can result in uncontrolled and sudden movement of the piping as the high pressure fluid escapes. This creates an extreme hazard to surrounding persons, equipment, structure, or other property. Relief valve assemblies 11 can tip over during testing and operation and thus can cause injury to personnel or damage to equipment and property. Maintaining the relief valve assembly 11 in an upright position is thus an advantageous function of the stand assembly 30 of the present invention.

For example, the stand assembly 30 is rigidly connected to the valve assembly 11 at the tee 14 and at the cylinder 26. Saddles 54 located on the stand assembly 30 transfer the forces from the frac lines 13 to the frame 32 via the clamps 16 secured to the tee 14. Further, the top of the valve assembly 11 is maintained upright via the connection of the cylinder 26 to the flanges 36 on the stand assembly 30. Any forces transferred from the frac lines 13 up to the valve assembly 11 are transferred to the flanges 36 and down to the brace links 34 and frame 32. The stand assembly 30 is easily and conveniently preassembled and may be brought to the well site already assembled with valves 20, 24 and tee 14. Further, the top ends of the brace links 34 can be disconnected from the flanges 36 and swiveled diagonally outward at the frame clevises 58 to allow access to the valve assembly 11 and its components for maintenance. Thus, potential injury, death and/or loss of property due to a valve assembly tipping over are greatly reduced in a convenient and simple manner due to the stand assembly 30.

This written description uses examples to disclose the invention, including the best mode, and also enable a person of ordinary skill in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus for supporting a pressure relief valve that is attached to a main flow line, comprising:

a base set on the main flow line, the base comprising:

at least one lower tube that forms a lower rectangle;

at least one upper tube that forms an upper rectangle; and at least one vertical tube extending between and connecting the at least one upper tube to the at least one lower tube;

at least one saddle mounted to the base, the at least one saddle having an upward facing surface for supporting the main flow line adjacent the pressure relief valve;

a flange adapted to be secured to an upper portion of the pressure relief valve; and elongated support members each having a base end pivotingly coupled to the base, and a flange end coupled to the flange;

wherein the flange ends of the support members are released from the flange, thereby enabling the support members to pivot about the base ends from an inward inclined position with the flange ends fastened to the flange, to an outward position with the flange ends disconnected from the flange, thereby allowing access to the relief valve.

2. The apparatus of claim 1, wherein the upward facing surface of the at least one saddle is located above the lower rectangle.

3. The apparatus of claim 1, wherein the upward facing surface of the at least one saddle contacts a tee.

4. The apparatus of claim 1, wherein the flange comprises at least one lifting loop secured to the flange for lifting the apparatus.

5. The apparatus of claim 1, wherein the flange is adapted to be rigidly fastened to the upper portion of the pressure relief valve via a set of bolt openings formed on the flange.

6. The apparatus of claim 1, wherein a plurality of clevises are located at the flange and connect the flange ends of the elongated support members to the flange.

7. The apparatus of claim 1, wherein a plurality of clevises are located at upper corners of the base to receive and connect the base ends of the elongated support members to the base.

8. The apparatus of claim 1, wherein the pressure relief valve has a lower end and the main flow line has a tee, and wherein the lower end of the pressure relief valve is attached to the tee of the main flow line;

wherein the tee has two horizontally extending conduits in alignment with each other and a vertical conduit extending upward from an intersection of the horizontal conduits;

wherein the base is adapted to be positioned around the tee, and the upward facing surface of the at least one saddle supports the horizontal conduits of the tee to support the tee within the base; and wherein the apparatus further comprises:

a clamp for the at least one saddle for securing the horizontal conduits of the tee to the at least one saddle.

9. A pressure relief valve assembly, comprising:

a pressure relief valve connected to a flow line;

a valve support, comprising:

a base having front and back lower tubes that are joined to right and left side lower tubes to define a lower rectangle;

a plurality of cross braces extending between the front and back lower tubes;

at least one saddle fastened to one of the cross braces and having a surface for supporting the flow line adjacent the pressure relief valve;

a flange extending around and being secured to an upper portion of the relief valve;

a plurality of links, each having a lower end pivotally connected to the base and an upper end; and wherein each of the links is pivotal in a plane through which a vertical axis passes about the lower end from an open position wherein the upper ends of the links are spaced radially outward from the flange, to an inward inclined position wherein the upper ends of the links are connected to the flange.

10. The assembly of claim 9, wherein the base further comprises:

front and back tubes that are joined to right and left side upper tubes to define an upper rectangle;

the upper rectangle being located above the lower rectangle;

a plurality of vertical tubes joining each respective corner of the lower and upper rectangles to form a box shape; and wherein the lower ends of the links are secured to respective corners of the upper rectangle.

11. The assembly of claim 10, wherein the flange comprises a flat plate located in a plane perpendicular to the vertical axis.

12. The assembly of claim 9, wherein the flange further comprises:

at least one lifting loop secured to the flange for lifting the valve support; and at least one lifting loop secured to a top of the pressure relief valve for lifting the pressure relief valve.

13. The assembly of claim 9, wherein the flange is rigidly fastened to the upper portion of the pressure relief valve via a set of bolt openings formed on the flange.

14. The assembly of claim 9, wherein the flange comprises two plates located in a common plane that is perpendicular to the vertical axis.

15. The assembly of claim 9, further comprising clevises located at upper corners of the base to receive and connect the lower ends of the links.

16. The pressure relief valve assembly of claim 9, further comprising:

a tee for connection to the flow line, the tee having aligned horizontal conduits and a vertical conduit extending upward along the vertical axis from an intersection of the horizontal conduits, and wherein the surface of the at least one saddle supports the horizontal conduits of the tee.

17. The assembly of claim 16, wherein the vertical conduit of the tee extends above the lower rectangle.

18. A pressure relief valve assembly, comprising:

a pressure relief valve;

a tee connected to a lower end of the valve adapted for connecting to a frac line;

a base fabricated from a plurality of tubing members joined end to end to form a box;

a plurality of saddles fastened to a lower portion of the base, a clamp fastened to each saddle to retain the tee on the saddles;

a plurality of links, each of the links connected at a lower end to the upper corners of the base by a plurality of clevises, the clevises oriented around the vertical axis of the valve to allow pivoting of the links toward the vertical axis of the valve;

a pair of flanges each having a plate with a plurality of clevises for connecting the flange to upper ends of the links, the flange closely receiving an upper portion of the relief valve, the flange having a bolt pattern that fastens to a cylinder portion of the relief valve;

a lifting loop secured onto each of the flanges for allowing lifting of the flanges; and a lifting eye welded onto a top of the relief valve for lifting.

19. The assembly of claim 18, wherein the tubing members forming the base further comprise:

a plurality of lower steel tubes joined end to end to form a lower rectangle;

a plurality of upper steel tubes joined end to end to form an upper rectangle wherein the upper steel tubes are located above the lower steel tubes;

a plurality of vertical steel tubes joining each respective corner of the lower and upper rectangles to form the box; and a plurality of cross braces connected at each end to a pair of the lower steel tubes.

20. The assembly of claim 19, wherein each saddle is fastened to one of the cross braces.

* * * * *